US008186148B2

(12) United States Patent
Gabe et al.

(10) Patent No.: US 8,186,148 B2
(45) Date of Patent: May 29, 2012

(54) EXHAUST GAS PURIFYING METHOD AND PURIFIER

(75) Inventors: Masashi Gabe, Fujisawa (JP); Daiji Nagaoka, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 815 days.

(21) Appl. No.: 11/886,688

(22) PCT Filed: Apr. 20, 2006

(86) PCT No.: PCT/JP2006/308281

§ 371 (c)(1),
(2), (4) Date: Sep. 19, 2007

(87) PCT Pub. No.: WO2006/115158

PCT Pub. Date: Nov. 2, 2006

(65) Prior Publication Data

US 2008/0202098 A1 Aug. 28, 2008

(30) Foreign Application Priority Data

Apr. 21, 2005 (JP) ..... 2005-123475

(51) Int. Cl.
*F01N 3/00* (2006.01)
*F01N 3/10* (2006.01)

(52) U.S. Cl. ..... 60/285; 60/295; 60/301

(58) Field of Classification Search ..... 60/273, 60/285, 295, 297, 301, 311, 274
See application file for complete search history.

(56) References Cited

U.S. PATENT DOCUMENTS

| | | | | |
|---|---|---|---|---|
| 2003/0110760 | A1 | 6/2003 | Shirakawa | |
| 2004/0261414 | A1 * | 12/2004 | Araki | 60/602 |
| 2005/0022503 | A1 * | 2/2005 | Miura | 60/274 |
| 2006/0064228 | A1 * | 3/2006 | Huang | 701/104 |

FOREIGN PATENT DOCUMENTS

| | | | |
|---|---|---|---|
| EP | 1 503 065 | A2 | 2/2005 |
| JP | 04153575 | A * | 5/1992 |
| JP | 6-336916 | | 12/1994 |
| JP | 2000-154748 | | 6/2000 |
| JP | 2000-356127 | | 12/2000 |
| JP | 2001-200715 | | 7/2001 |

(Continued)

OTHER PUBLICATIONS

Hori et al, English Abstract of JP 04-153575 A, May 27, 1992.*

(Continued)

*Primary Examiner* — Thomas Denion
*Assistant Examiner* — Audrey K Bradley
(74) *Attorney, Agent, or Firm* — Staas & Halsey LLP

(57) ABSTRACT

An exhaust gas purification system performing regeneration control in a rich condition by using control of an intake system for reducing the quantity of intake air together with control of a fuel system for increasing fuel injection amount into a cylinder. Timing for injecting fuel into the cylinder is varied in response to a continuous variation of an air fuel ratio in the cylinder during switching intervals between a lean condition and the rich condition at the time of regeneration control of a NOx purification catalyst. During a period of transition to rich condition or lean condition, misfiring, combustion noise, torque variation, deterioration in drivability, and the like, due to undue advance angle or lag angle in the timing for injecting fuel into the cylinder, can thereby be prevented.

3 Claims, 7 Drawing Sheets

FOREIGN PATENT DOCUMENTS

| | | |
|---|---|---|
| JP | 2002-195072 | 7/2002 |
| JP | 2005-90278 | 4/2005 |

OTHER PUBLICATIONS

European Search Report dated Sep. 10, 2009 in corresponding European Patent Application 06732139.8.
International Search Report (PCT/ISA/210) of International Application PCT/JP2006/308281 (mailed on Jun. 20, 2006).
Patent Abstracts of Japan, Publication No. 6-336916, Publication Date Dec. 6, 1994.
English Translation of Japanese Publication No. 6-336916, Publication Date Dec. 6, 1994.
Patent Abstracts of Japan, Publication No. 2000-154748, Publication Date Jun. 6, 2000.
English Translation of Japanese Publication No. 2000-154748, Publication Date Jun. 6, 2000.

* cited by examiner

EXHAUST GAS PURIFYING METHOD AND PURIFIER

This application claims the benefit under 35 U.S.C. §371, of PCT International Application Number PCT/JP2006/308281, filed Apr. 20, 2006 and Japanese Application No. 2005-123475, filed Apr. 21, 2005, in Japan, the contents of which are incorporated herein by reference.

FIELD OF THE INVENTION

The present invention relates to an exhaust gas purification method and an exhaust gas purification system, including a NOx purification catalyst that reduces and purifies NOx (nitrogen oxide) in exhaust gas from internal combustion engines.

DESCRIPTION OF THE RELATED ART

There have been different NOx catalysts studied and proposed for use in reducing and removing NOx in exhaust gas from internal combustion engines that includes diesel engines and some gasoline engines, and from various other combustion devices. Those NOx catalysts include a NOx occlusion reduction type catalyst and a NOx direct reduction type catalyst as the DeNOx catalyst for use in diesel engines. Using these catalysts enables NOx in the exhaust gas to be effectively purified.

The NOx occlusion reduction type catalyst is a catalyst in which an oxide support layer such as alumina ($Al_2O_3$) or zeolite supports a catalytic noble metal facilitating a redox reaction, and NOx occlusion material (NOx occlusion substance) with a NOx occlusion function. As the catalytic noble metal, platinum (Pt), palladium (Pd), or the like is used. Also, as the NOx occlusion material, alkali metals such as potassium (K), sodium (Na), lithium (Li), and cesium (Cs), alkali earth metals such as barium (Ba) and calcium (Ca), and rare earth metals such as lanthanum (La) and yttrium (Y) are used.

With the NOx occlusion reduction type catalyst, if the air/fuel ratio of the exhaust gas flowing in is lean (excessive oxygen) and $O_2$ (oxygen) is contained in the atmosphere, NO (nitric monoxide) in the exhaust gas is oxidized into $NO_2$ (nitric dioxide) by the noble metal. The $NO_2$ accumulates in the NOx occlusion material as nitrate ($Ba_2NO_4$, etc.).

On the other hand, if the air/fuel ratio of the exhaust gas flowing in becomes a theoretical air/fuel ratio or is rich (low oxygen concentration), and no oxygen is contained in the atmosphere, NOx occlusion material such as Ba combines with carbon monoxide (CO), and $NO_2$ resulting from decomposition of the nitrate is released. The released $NO_2$ is reduced into nitrogen ($N_2$) with unburned carbon hydride (HC), CO, etc. contained in the exhaust gas with the aid of the three-way function of the noble metal. Consequently, components in the exhaust gas are released into the air as harmless materials such as carbon dioxide ($CO_2$), water ($H_2O$), and nitrogen ($N_2$).

For this reason, in an exhaust gas purification system provided with a NOx occlusion reduction type catalyst, as a NOx occluding ability approaches saturation, a regenerating operation is performed to regenerate the catalyst by releasing the occluded NOx. In the regenerating operation, the amount of fuel increases more than that in the theoretical air/fuel ratio so as to make the air/fuel ratio of the exhaust gas rich and thereby the exhaust gas has a reductive composition in which the oxygen concentration in the exhaust gas flowing in decreases and is supplied to the catalyst. By performing richness control to recover the NOx occluding ability, the absorbed NOx is released and the released NOx is reduced with the aid of the noble metal catalyst.

Also, in order to make the NOx occlusion reduction type catalyst effectively function, a reducing agent of the necessary amount and sufficient to reduce the NOx occluded while in the lean condition should be supplied while in the rich condition. However, with diesel engines, attempting to enrich the mix through the fuel system only results in a fuel efficiency deteriorating. Accordingly, for example, in Japanese Patent Application Kokai publication No. 1994-336916, in order to generate the reducing exhaust gas, the air-intake amount is decreased and the combustion in the cylinder is switched to being rich. The decrease of air-intake amount is carried through throttling the air intake amount with a throttle valve and opening an EGR valve to thereby supply a large amount of EGR gas. Also, the rich combustion is carried by adding fuel to increase the level of richness.

On the other hand, with the NOx direct reduction type catalyst, a support body such as β-zeolite is made to support a metal such as rhodium (Rh) or palladium (Pd), which are catalytic components. In addition, the following steps are performed: Cerium is mixed, which suppresses oxidation action of the metal and contributes to retention of the NOx reduction capability. A three-way catalyst is provided in a lower layer to facilitate redox reaction, particularly the reductive reaction of NOx while in the rich condition. Iron (Fe) is added to the support body to improve NOx conversion efficiency.

The NOx direct reduction type catalyst directly reduces NOx into nitrogen ($N_2$) in oxygen rich atmospheres like exhaust gases in which the air/fuel ratio of the exhaust gas from an internal combustion engine such as a diesel engines is lean. However, at the time of the reduction, oxygen ($O_2$ is adsorbed by the metal, which is the active catalyst material, thereby deteriorating reduction performance. For this reason, the oxygen concentration in the exhaust gas should be made basically zero so that the air/fuel ratio of the exhaust gas becomes the theoretical air/fuel ratio or rich, and thereby regenerate and activate the active material of the catalyst.

Then, similarly to the NOx occlusion reduction type catalyst, in a normal engine operating condition, i.e., when the air/fuel ratio of the exhaust gas is lean, the NOx is purified. The catalyst oxidized at the time of the purification is reduced to recover the NOx purifying capability while in the rich condition.

However, if during the rich combustion for regeneration control, fuel is injected at the same timing as that of injection timing of fuel for lean combustion, ignition delay increases and misfires occur because the air-intake amount has been decreased by a large amount of inert gas (EGR gas) and the air-intake throttling. Accordingly, when combustion is switched to the rich combustion, the injection timing of fuel is advanced by approximately 10°.

However, in a case of the rich control performed in the combination of an air-intake system and a fuel system, there is a difference in responsiveness between the control of the air-intake system and that of the fuel system. That is, with richness being controlled by the air-intake system, a large amount of EGR gas is circulated to decrease the oxygen concentration in the intake air. However, as the circulation of the EGR gas takes a long time, attaining the target air/fuel ratio also takes a long time. Accordingly, response becomes sluggish, and the responsiveness of control by the air-intake system is low. On the other hand, with the richness being controlled by the fuel system, injection timing in the fuel system very quickly advances or delays in angle compared with the relatively moderate change in the air-intake system.

Accordingly, as shown by "t1" in FIG. 7, when the condition moves from being lean condition for normal operation to rich condition for regeneration control, i.e., during the initial transition to rich combustion, injection timing T of the fuel system has advanced in angle before air excess ratio λ of the air-intake system reaches rich condition λq. Also, as shown by "t2" in FIG. 7, when the condition is moved from being rich condition for regeneration control to lean condition for normal operation, i.e., during the initial transition to lean combustion, injection timing T of the fuel system has delayed in angle before the air excess ratio λ of the air-intake system reaches lean condition λl. Accordingly, the problems arise that the NOx generation amount Cnoxin, combustion noise, torque, etc. rapidly increased, thus resulting in significant deterioration of drivability.

In addition, when the air excess ratio is switched, the change in the actual air-intake amount is delayed relative to the change in the target air-intake amount, and also delayed relative to the change in the fuel injection amount. For this reason, misfire occurs due to being over rich, emissions deteriorate, and torque shock occurs. In order to prevent these phenomena, in Japanese Patent Application Kokai publication No. 2000-154748, based on a detected or estimated actual air-intake amount and a configured stable combustion λ range in which the air-fuel mixture stably combusts, the fuel injection amount is limited in order for the actual air excess ratio λ to enter the stable combustion λ range. Furthermore, there has been proposed an internal combustion engine control unit whereby the injection timing of fuel changes based on the relationship between the fuel injection amount and the stable combustion λ range. With the unit, during control of reducing and purifying NOx in the NOx occlusion reduction type catalyst (during regeneration control), the injection timing of fuel changes to homogeneous combustion mode.

However, the change in the injection timing of fuel with the internal combustion engine control unit refers to a change between a stratified combustion mode for λ=1.3 to 3 and homogeneous combustion mode for λ=0.7 to 1.4. That is, the injection timing of fuel for each of the modes does not change consecutively. Accordingly, the problem arising from the difference between the very rapid change in the injection timing of fuel provided by electronic control and the slow response change of the air-intake system as described above, i.e., the problem arising during the transition to rich combustion or during the transition to lean combustion cannot be solved.

Patent document 1: Japanese Patent Application Kokai publication No. 1994-336916

Patent document 2: Japanese Patent Application Kokai publication No. 2000-154748

SUMMARY OF THE INVENTION

The present invention is made to solve the above problems, and has an object to provide an exhaust gas purification method and an exhaust gas purification system capable of, in the exhaust gas purification system including the NOx purification catalyst for recovering the NOx purifying ability to purify NOx in the exhaust gas when the exhaust gas flowing in is in the rich condition, preventing the misfire, combustion noise, torque change, and deterioration in drivability and the like caused by excessively advanced angle or delayed angle of the injection timing of fuel injection into the cylinder during the transition to the rich condition or transition to a lean condition.

The exhaust gas purification method to accomplish the above object includes: in an exhaust gas purification system that has: a NOx purification catalyst for purifying NOx when an air/fuel ratio of exhaust gas is in a lean condition, and for recovering a NOx purifying ability when it is in a rich condition, and catalyst regeneration controlling means for performing regeneration control to recover the NOx purifying ability of the NOx purification catalyst; and uses air-intake system control for decreasing an air-intake amount and fuel system control for increasing a fuel injection amount into a cylinder in combination to thereby control the rich condition for the regeneration control; the method including the step of, changing an injection timing of fuel injection into the cylinder in response to a time-dependent change in a combustion air/fuel ratio in the cylinder during the switching intervals between the lean condition and the rich condition in the regeneration control of the NOx purification catalyst.

The NOx purification catalyst herein includes the NOx occlusion reduction type catalyst and the NOx direct reduction type catalyst. Also, the recovery of the NOx purifying ability includes the recovery of the NOx occluding ability and that from sulfur poisoning in the NOx occlusion reduction type catalyst, and the recovery of the NOx reducing ability and that from the sulfur poisoning in the NOx direct reduction type catalyst.

With this method, the injection timing of fuel is not advanced or delayed in angle at once to a predetermined target timing during the switching intervals between the lean and rich combustion conditions in the regeneration control for recovering the NOx purifying ability of the NOx purification catalyst. But, the injection timing of fuel is advanced or delayed in angle in response to the combustion air/fuel ratio in the cylinder, which exhibits a relatively slow change due to the air-intake throttling and EGR control in the air-intake system. This suppresses the NOx generation, combustion noise generation, rapid change in torque, deterioration in drivability, etc.

The above exhaust gas purification method includes advancing in angle the injection timing of the fuel injection into the cylinder so as to bring it to the injection timing of fuel calculated based on the time-dependent change in the combustion air/fuel ratio in the cylinder during the switching intervals from the lean condition to the rich condition at the beginning of the regeneration control.

Also, the above exhaust gas purification method includes delaying in angle the injection timing of the fuel injection into the cylinder so as to bring it to the injection timing of fuel calculated based on the time-dependent change in the combustion air/fuel ratio in the cylinder during the switching intervals from the rich condition to the lean condition at the end of the regeneration control.

The exhaust gas purification system to accomplish the above object is configured to include, a NOx purification catalyst for purifying NOx when an air/fuel ratio of exhaust gas is in a lean condition, and for recovering a NOx purifying ability when it is in a rich condition, and catalyst regeneration controlling means for performing regeneration control to recover the NOx purifying ability of the NOx purification catalyst; and use air-intake system control for decreasing an air-intake amount and fuel system control for increasing a fuel injection amount into a cylinder in combination to thereby control the rich condition for the regeneration control; wherein the catalyst regeneration controlling means changes the injection timing of fuel injection into the cylinder in response to a time-dependent change in a combustion air/fuel ratio in the cylinder during the switching intervals between the lean condition and the rich condition in the regeneration control of the NOx purification catalyst.

The exhaust gas purification system having the above configuration enables the above exhaust gas purification method to be performed, and the same effect as those in the method to be produced.

The above exhaust gas purification system is configured such that the catalyst regeneration controlling means advances in angle the injection timing of fuel injection into the cylinder so as to bring it to the injection timing of fuel calculated based on the time-dependent change in the combustion air/fuel ratio in the cylinder during the switching intervals from the lean condition to the rich condition at the beginning of the regeneration control.

Also, the above exhaust gas purification system is configured such that the catalyst regeneration controlling means delays in angle the injection timing of the fuel injection into the cylinder so as to bring it to the injection timing of fuel calculated based on the time-dependent change in the combustion air/fuel ratio in the cylinder during the switching intervals from the rich condition and the lean condition at the end of the regeneration control.

The exhaust gas purification system can provide and produce large effects if the NOx purification catalyst is a NOx occlusion reduction type catalyst for occluding NOx when the air/fuel ratio of the exhaust gas is in the lean condition, and releases and for reducing the occluded NOx when it is in the rich condition, or a NOx direct reduction type catalyst that reduces and purifies the NOx when the air/fuel ratio of the exhaust gas is in the lean condition, and for recovering the NOx purifying ability when it is in the rich condition.

Note that the combustion air/fuel ratio in the cylinder herein refers to an air/fuel ratio in combustion in the cylinder, and is used to distinguish from an air/fuel ratio of the exhaust gas that is a ratio between an air amount supplied into the exhaust gas flowing into the NOx occlusion reduction type catalyst and the fuel amount (including an amount combusted in the cylinder).

As described above, the exhaust gas purification method and exhaust gas purification system according to the present invention advance or delay in angle the fuel injection time in response to the change of the combustion air/fuel ratio (air excess ratio $\lambda$) in the cylinder that is caused by the air-intake throttling and EGR control in the air-intake system, during the switching intervals between the combustion condition where the combustion air/fuel ratio in the cylinder becomes lean and that where it becomes rich in the regeneration control for recovering the NOx purifying ability of the NOx purification catalyst, without advancing or delaying the injection timing of the fuel at once to the predetermined timing, and thereby, can prevent the NOx generation, combustion noise, rapid change in torque, and extreme deterioration in drivability or the like.

DESCRIPTION OF THE EMBODIMENTS

The exhaust gas purification method and exhaust gas purification system according to embodiments of the present invention will hereinafter be described with reference to the drawings.

Figure 1:
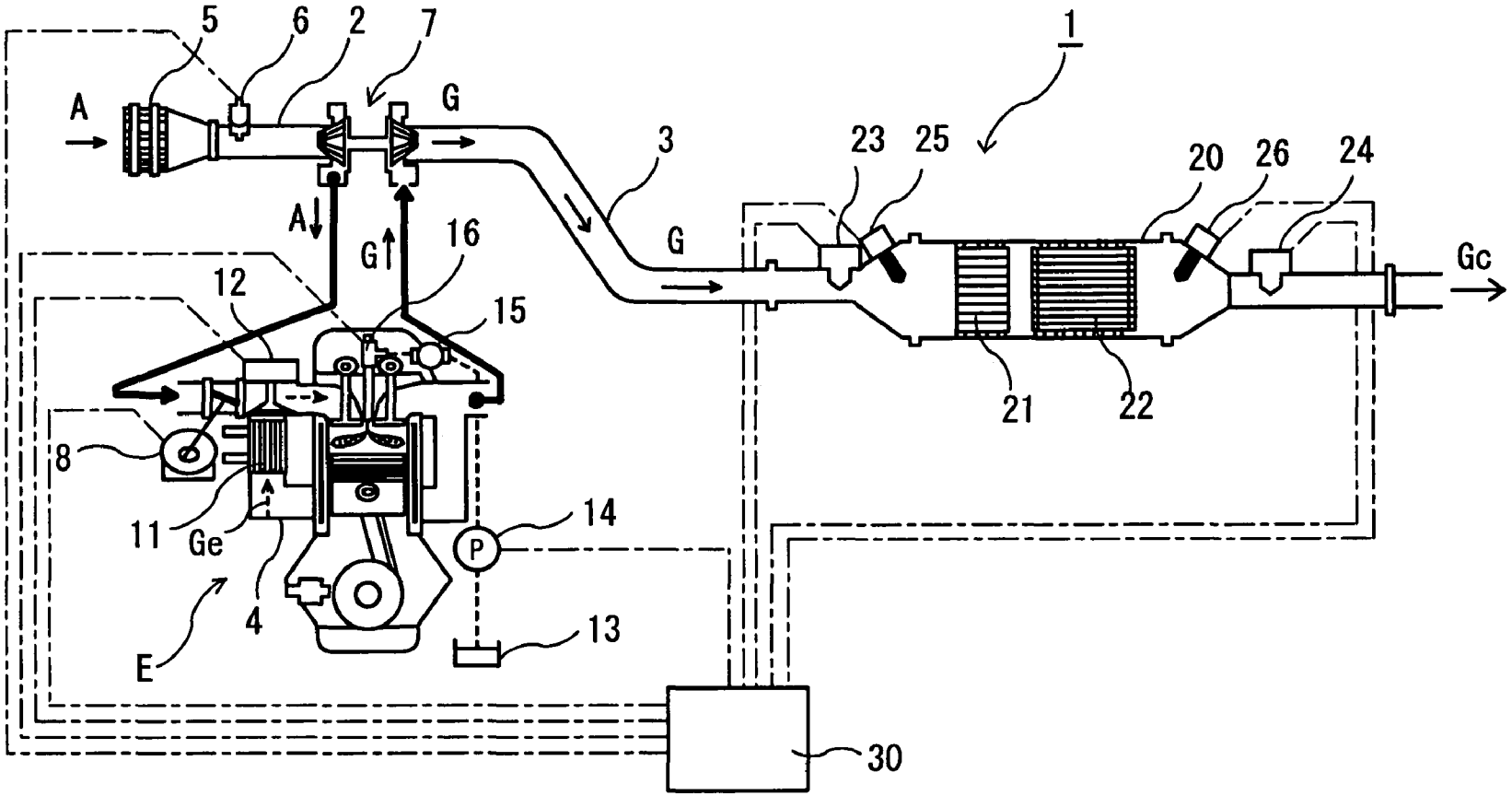
FIG. 1 is a diagram illustrating a configuration of the exhaust gas purification system according to an embodiment of the present invention.

FIG. 1 shows a configuration of the exhaust gas purification system 1 according to an embodiment of the present invention. In the exhaust gas purification system 1, an exhaust gas purification device 20 including an oxidation catalyst 21 and a NOx occlusion reduction type catalyst 22 is arranged in an exhaust passage 3 of an engine (internal combustion engine) E.

The oxidation catalyst 21 is formed as follows: a catalyst coat layer such as activated aluminum oxide ($Al_2O_3$) is provided on a surface of a support body made of honeycomb cordierite or heat resistant steel. The catalyst coat layer is made to support a catalyst active component made of a noble metal such as platinum (Pt), palladium (Pd) and rhodium (Rh). The oxidation catalyst oxidizes HC, CO, etc. in exhaust gas flowing therein. This brings the exhaust gas into a low oxygen condition, and also combustion heat increases exhaust gas temperature.

The NOx occlusion reduction type catalyst 22 is configured such that a monolithic catalyst is provided with the catalyst coat layer. The monolithic catalyst is formed of cordierite or silicon carbide (SiC) extremely thin plate stainless steel. The support body formed of a monolithic catalyst structure body includes a large number of cells. The catalyst coat layer is formed of aluminum oxide ($Al_2O_3$), titanium oxide (TiO), etc. The catalyst coat layer provided on inner walls of the cells has a large surface area, which enhances contact efficiency with the exhaust gas. The catalyst coat layer is made to support the catalytic metal such as platinum (Pt) or palladium (Pd), and a NOx occlusion material (NOx occlusion substance) such as barium (Ba).

In the NOx occlusion reduction type catalyst 22, the NOx occlusion material occludes the NOx in the exhaust gas to thereby purify the NOx in the exhaust gas in an exhaust gas condition where an oxygen concentration is high (lean air/fuel condition). On the other hand, in the exhaust gas condition where the oxygen concentration is low or zero (rich air/fuel condition), the occluded NOx is released. Along with this, the released NOx is reduced with the aid of an catalytic action of the catalytic metal. These steps prevent the NOx from flowing out to air.

Also, a first exhaust component concentration sensor 23 is arranged on an upstream side of the oxidation catalyst 21. On a downstream side of the NOx occlusion reduction type catalyst 22, a second exhaust component concentration sensor 24 is arranged. The exhaust component concentration sensors 23 or 24 are a combination of a $\lambda$ sensor (air excess ratio sensor), a NOx concentration sensor and an oxygen concentration sensor. In addition, instead of the first or second exhaust component concentration sensor 23 or 24, the oxygen concentration sensor or air excess ratio sensor may be used.

However, in such a case, the NOx concentration sensor is separately provided, or control not using measured NOx concentration values is employed. Also, in order to detect a temperature of the exhaust gas, a first temperature sensor 25 is arranged on the upstream side of the oxidation catalyst 21, and a second temperature sensor 26 is arranged on the downstream side of the NOx occlusion reduction type catalyst 22.

Further, there is provided a control unit (ECU: engine control unit) 30 for performing overall control of an operation of the engine E and performing recovery control of the NOx purifying ability of the NOx occlusion reduction type catalyst 22. To the control unit 30, detected values are input from the first and second exhaust component concentration sensors 23 and 24, the first and second temperature sensors 25 and 26, and the like. The control unit 30 outputs signals for controlling an air-intake throttle valve 8, EGR valve 12, fuel injection valve 16 of a common-rail electronically-controlled fuel injection device for fuel injection, and the like in the engine E.

In the exhaust gas purification system 1, air A passes through an air cleaner 5 and a mass air flow sensor (MAF sensor) 6 in an air-intake passage 2, and is compressed and pressurized by a compressor of a turbocharger 7. The air A then flows into a cylinder from an air-intake manifold after the amount of the air A has been adjusted in the air-intake throttle valve 8. On the other hand, the exhaust gas G generated in the cylinder flows into the exhaust passage 3 from an exhaust manifold, and drives a turbine of the turbocharger 7. Then, the exhaust gas G passes through the exhaust gas purification device 20 and becomes purified exhaust gas Gc. The purified exhaust gas Gc is exhausted out to the atmosphere through an un-shown silencer. Also, the exhaust gas G partially passes through an EGR cooler 11 in an EGR passage 4 as EGR gas Ge. The EGR gas Ge is re-circulated into the air-intake manifold after the amount of the EGR gas Ge has been adjusted in EGR valve 12.

Figure 2:
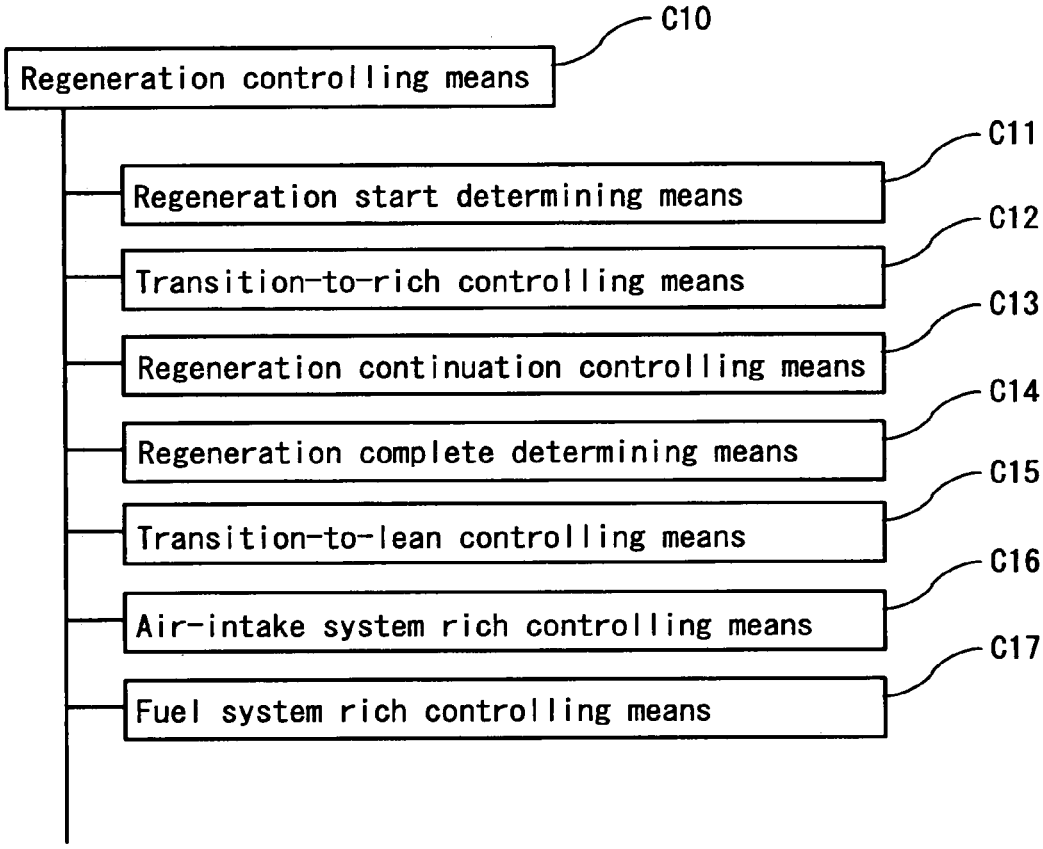
FIG. 2 is a diagram illustrating a configuration of controlling means of the exhaust gas purification system according to the embodiment of the present invention.

A control unit for the exhaust gas purification system 1 is incorporated into the control unit 30 for the engine E, and controls the exhaust gas purification system 1 in tandem with operation control of the engine E. The control unit for the exhaust gas purification system 1 is configured to include regeneration controlling means C10. As shown in FIG. 2, the regeneration controlling means C10 has regeneration start determining means C11, transition-to-rich controlling means C12, regeneration continuation controlling means C13, regeneration complete determining means C14, transition-to-lean controlling means C15, air-intake system rich controlling means C16, and fuel system rich controlling means C17.

Note that the regeneration control herein includes the catalyst regeneration control for recovering the NOx occluding ability of the NOx occlusion substance, and the desulfurization and regeneration control for purging sulfur from the catalyst to recover from sulfur poisoning of the catalyst due to a sulfur component in fuel.

In the catalyst regeneration control, the regeneration start determining means C11 accumulatively calculates a NOx exhaust amount per unit time ΔNOx based on an operating condition of the engine to obtain a NOx accumulated value ΣNOx. The means C11 determines that the regeneration is started, if the NOx accumulated value ΣNOx exceeds a criterion value Cn. Alternatively, the means C11 may calculate the NOx conversion efficiency based on NOx concentration on the upstream and downstream sides of the NOx occlusion reduction type catalyst 22, which are detected by the first and second exhaust component concentration sensors 23 and 24. Then, the means C11 determines that the regeneration of the NOx catalyst is started, if the calculated NOx conversion efficiency becomes lower than a predetermined criterion value.

Also, in the desulfurization control for recovering from the sulfur poisoning, the means C11 determines whether or not sulfur has been accumulated to the extent that the NOx occluding ability is reduced. A method for the determination includes a method in which C11 determines that the regeneration is started if a sulfur accumulated value ΣS, which is obtained by accumulatively calculating a sulfur accumulation amount S, exceeds a predetermined criterion value Cs.

The transition-to-rich controlling means C12 is means for advancing in angle a fuel injection timing T of main fuel injection into the cylinder so as to bring it to a fuel injection timing Tn calculated based on a change in combustion air/fuel ratio (air excess ratio λn) in the cylinder every moment during switching from the lean condition to the rich condition at the beginning of the regeneration control. In this control, at the start time of transition to the rich condition, the air-intake system rich controlling means C16 and the fuel system rich controlling means C17 decrease an air-intake amount and increase a fuel amount. Then, the fuel injection timing T is gradually advanced in angle from a lean fuel injection timing Tl to a target fuel injection timing Tq for rich combustion in response to the change in combustion air/fuel ratio (air excess ratio λn), which is a relatively slow change during the transition.

The regeneration continuation controlling means C13 is means for controlling the air/fuel ratio (air excess ratio λ) to make it stay in condition of a target air/fuel ratio (target air excess ratio λq) which is a stoichiometric air/fuel ratio (theoretical air/fuel ratio) or a rich air/fuel ratio. In this control, the air-intake system rich controlling means C16 and the fuel system rich controlling means C17 decrease the air-intake amount and increase the fuel amount; however, the fuel injection timing T is made to stay in a condition of the target fuel injection timing Tq.

In the regeneration control of the catalyst, the regeneration complete determining means C14 determines that the regeneration of the NOx catalyst is completed, in the following several manners: It is determined that the regeneration of the NOx catalyst is completed if a regeneration control duration has exceeded a predetermined time period. Alternatively, it may be determined that the regeneration of the NOx catalyst is completed if a NOx accumulated release value ΣNOxout obtained by accumulatively calculating a NOx release amount per unit time ΔNOxout from the NOx occlusion reduction type catalyst 20 based on the operating condition of the engine has exceeded a predetermined criterion value Cnout. Still alternatively, it may be determined that the regeneration of the NOx catalyst is completed if the NOx conversion efficiency calculated from the NOx concentration on the upstream and downstream sides of the NOx occlusion reduction type catalyst 20 has become higher than a predetermined criterion value. Also, in the desulfurization control, it is determined that the regeneration of the NOx catalyst is completed, in the following manner: A sulfur purge amount Sout is accumulatively calculated. If the accumulated sulfur purge amount ΣSout has exceeded the sulfur accumulation amount ΣS at the regeneration start time, it is determined that the regeneration of the NOx catalyst is completed.

The transition-to-lean controlling means C15 is means for delaying in angle the fuel injection timing T of the main fuel injection into the cylinder so as to bring it to the fuel injection timing Tn calculated based on the change in combustion air/fuel ratio (air excess ratio λn) in the cylinder every moment during switching from the rich condition to the lean condition at the end of the regeneration control. In this control, the air-intake system rich controlling means C16 and the fuel system rich controlling means C17 decrease the air-intake amount and increase the fuel amount at the start time of transition to the lean condition. Then, the fuel injection timing T is gradually delayed in angle from the target fuel injection timing Tq to the lean fuel injection timing Tl in response to the relatively slow change in combustion air/fuel ratio (air excess ratio λn).

Figure 3:
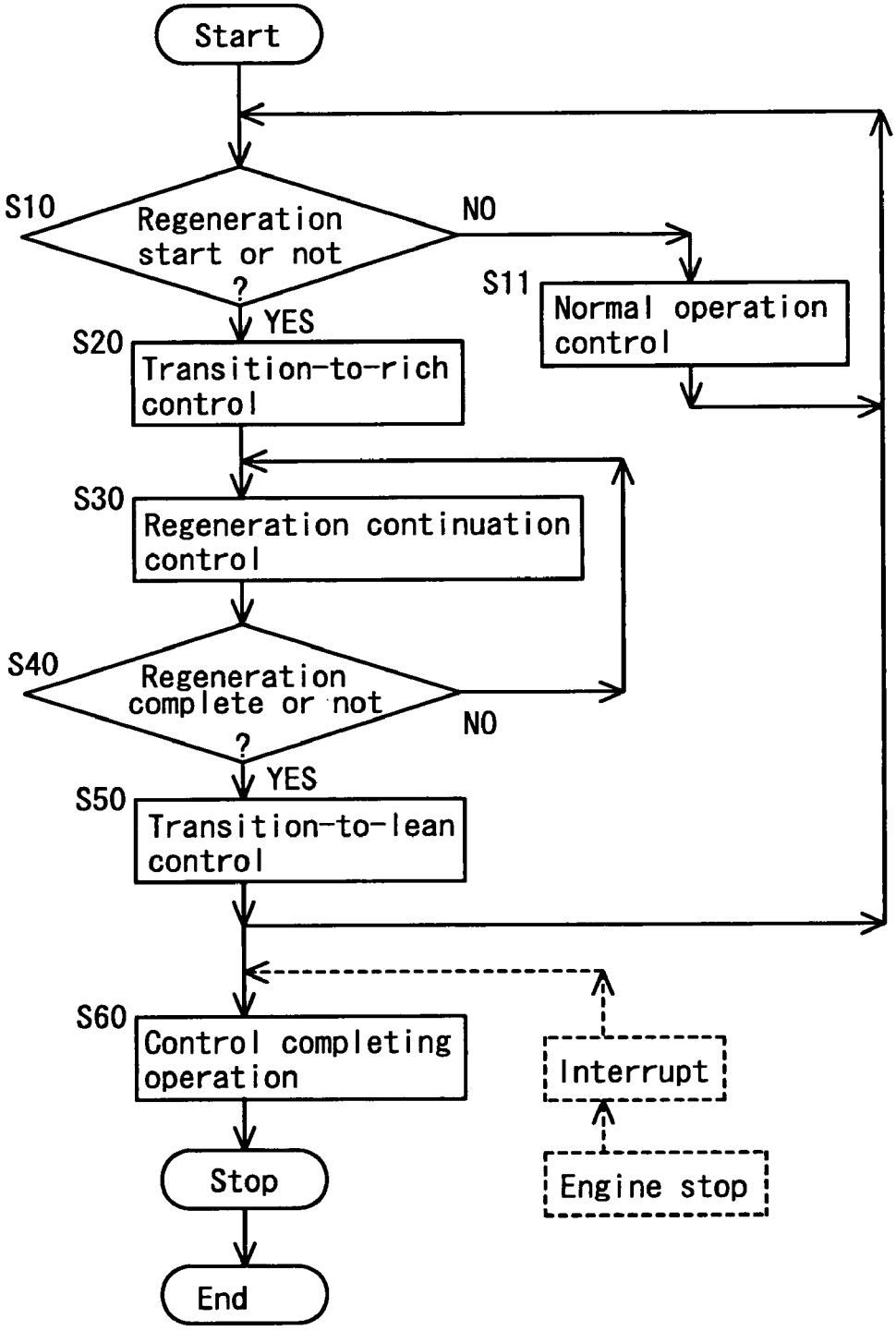
FIG. 3 is a diagram illustrating one example of a control flow for regenerating the NOx occlusion reduction type catalyst.
Figure 4:
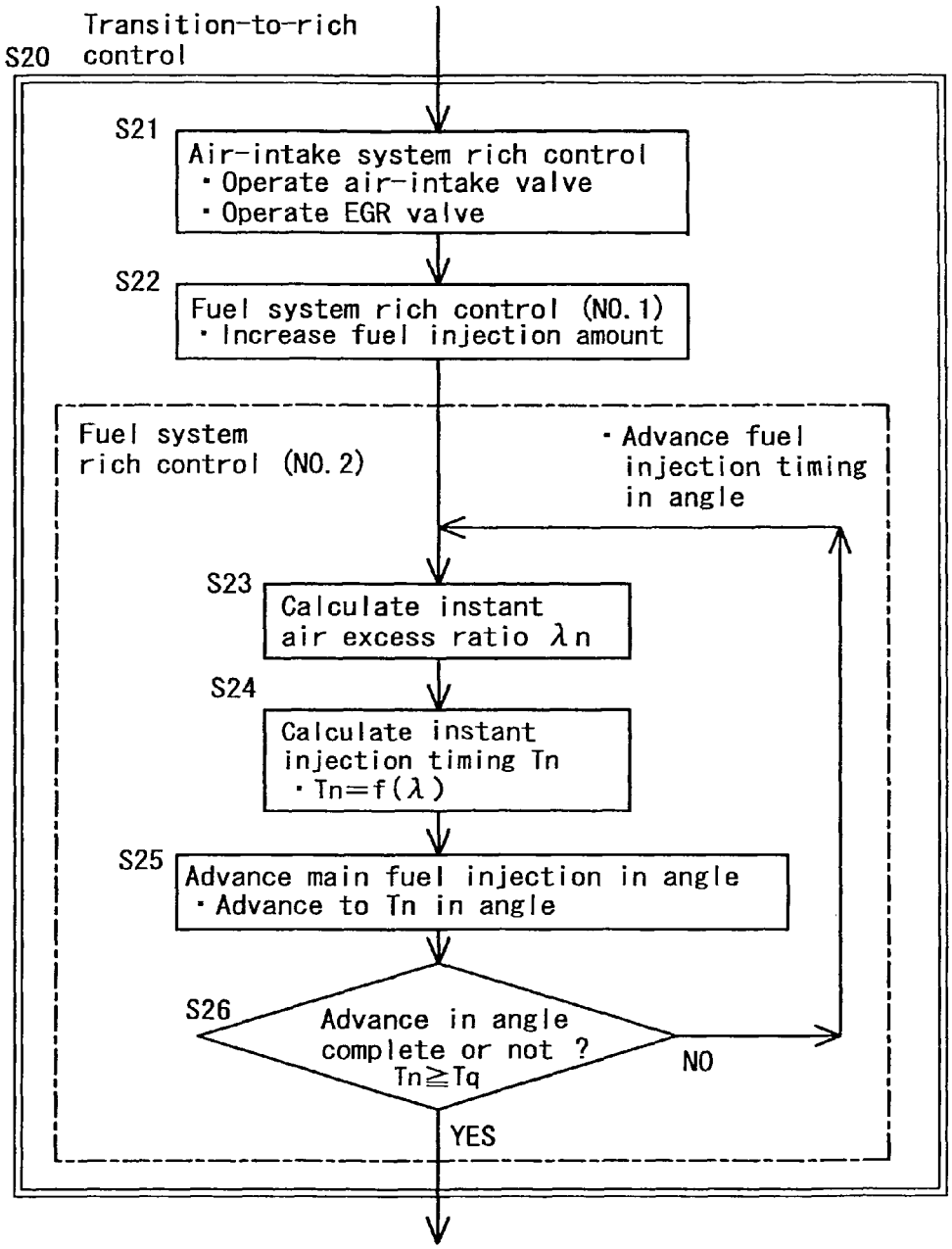
FIG. 4 is a diagram illustrating in detail a transition-to-rich control flow in the control flow of FIG. 3.
Figure 5:
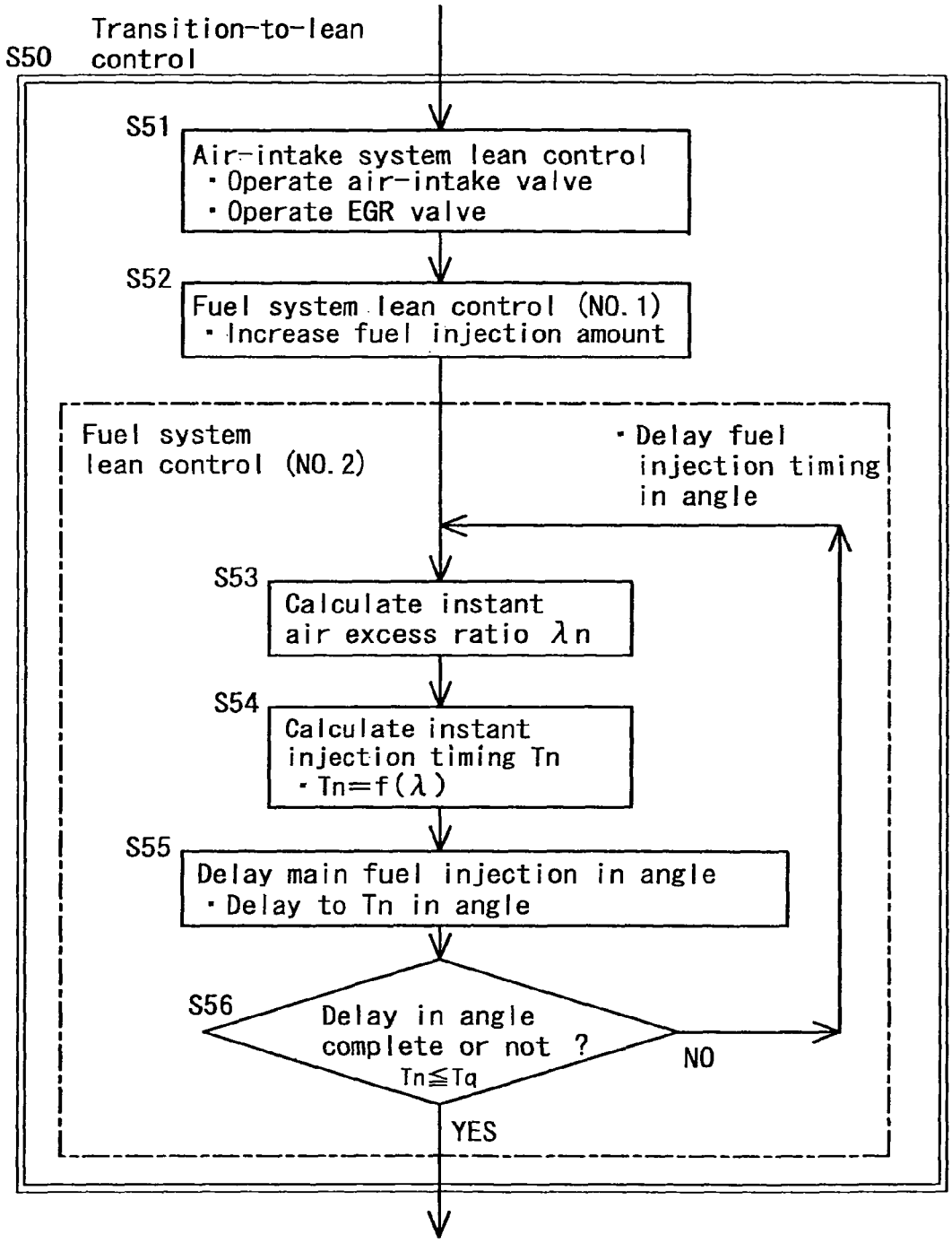
FIG. 5 is a diagram illustrating in detail a transition-to-lean control flow in the control flow of FIG. 3.
Figure 6:
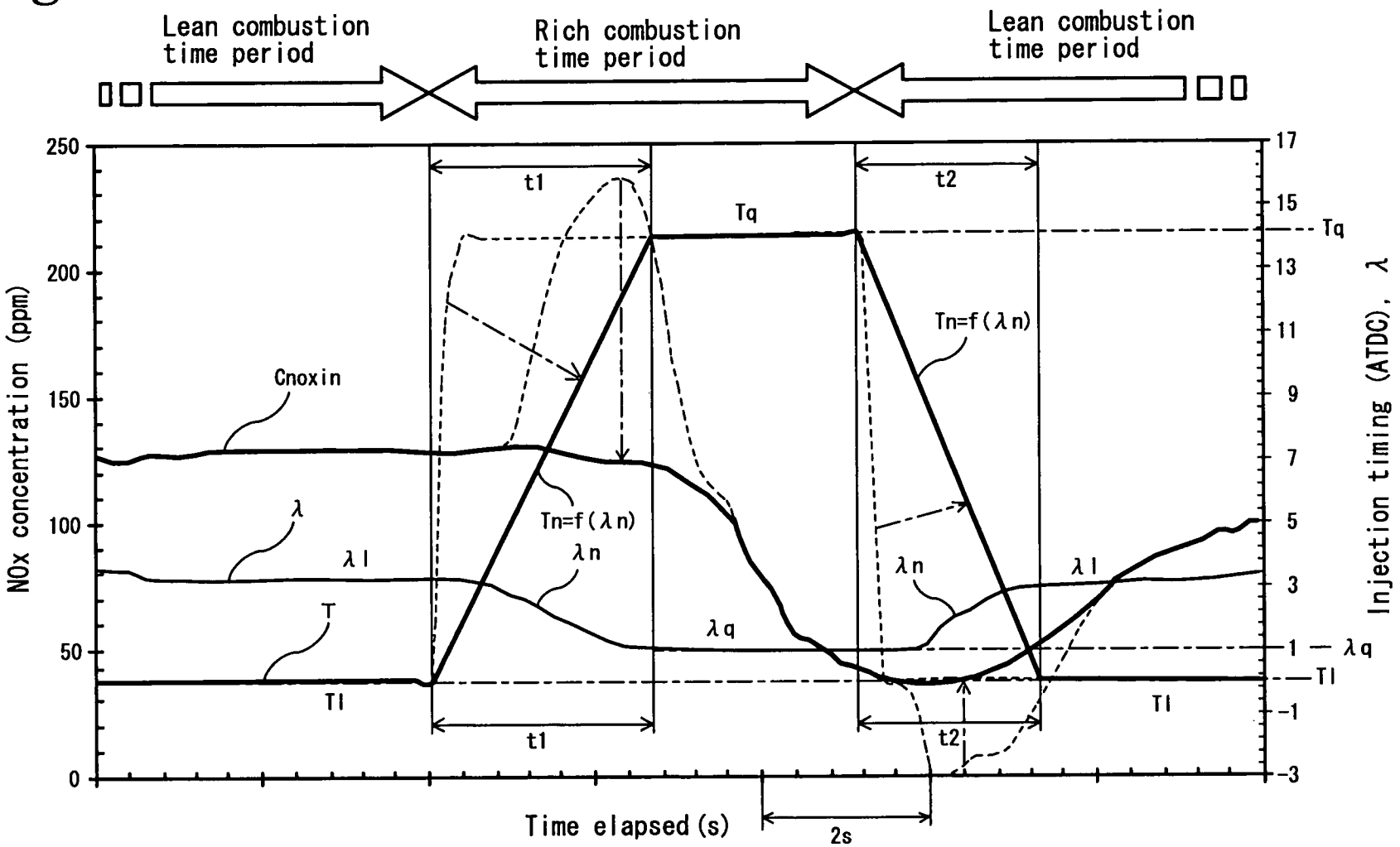
FIG. 6 is a time series diagram illustrating a relationship among the air excess ratio, the injection timing of fuel, and NOx concentration in the exhaust gas purification method according to the present invention in time series manner.
Figure 7:
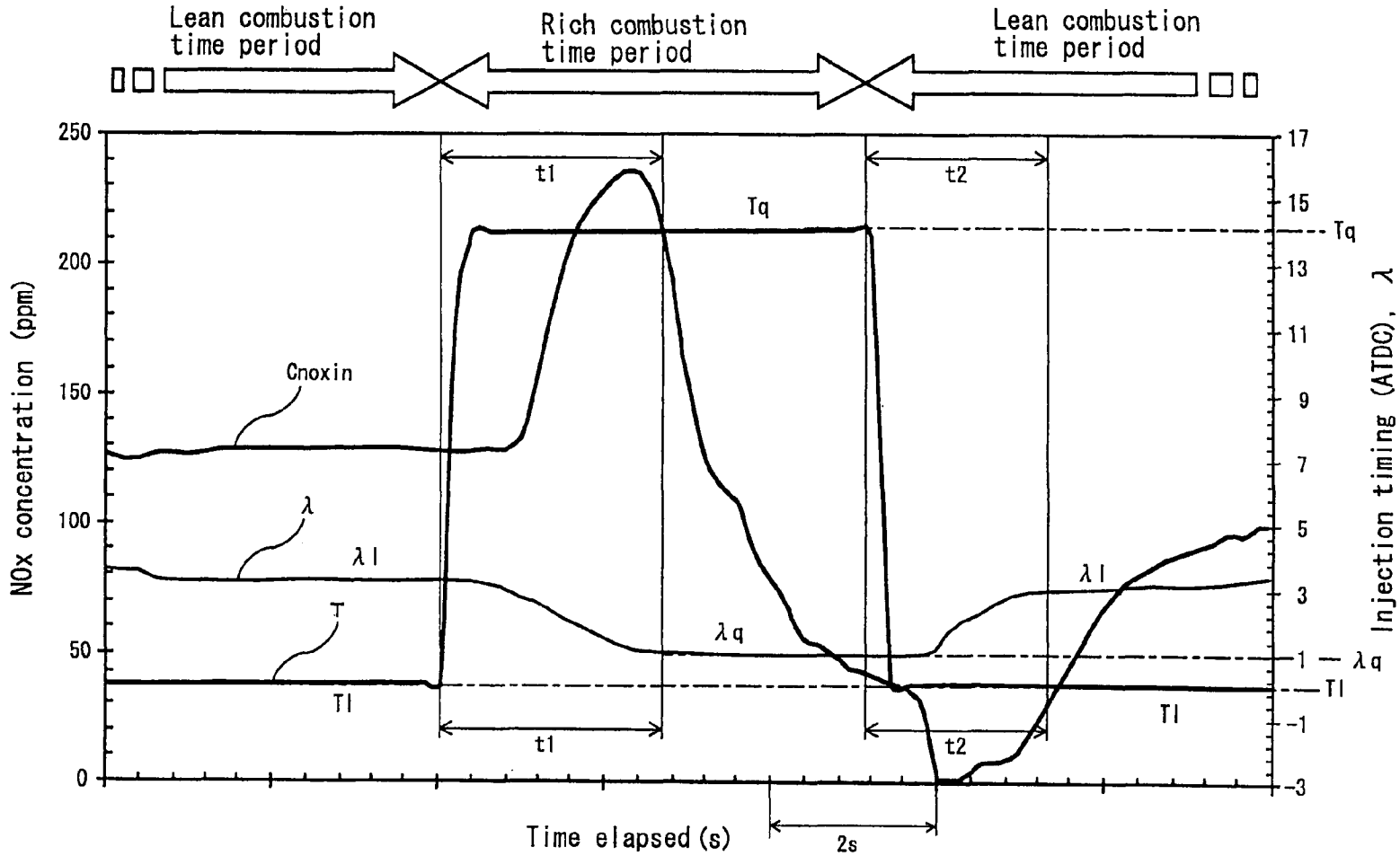
Fig.7 (Prior Art)
FIG. 7 is a time series diagram illustrating a relationship among the air excess ratio, the injection timing of fuel, and NOx concentration in the exhaust gas purification method according to the conventional technology in time series manner.

In the exhaust gas purification system 1, the regeneration controlling means C10 incorporated in the control unit 30 for the engine E performs the regeneration control of the NOx occlusion reduction type catalyst 20 according to a control flow as exemplified in FIGS. 3 to 5. Also, FIG. 6 shows one example of the air excess ratio λ, injection timing T of main fuel, and NOx concentration Cnoxin exhausted from the engine in time series manner based on the control flow in FIGS. 3 to 5. The NOx concentration Cnoxin corresponds to the NOx concentration on the upstream side of the NOx occlusion reduction type catalyst 20.

Note that the control flow in FIG. 3 is shown as being repeatedly performed in tandem with other control flows for the engine E while the engine E is operated.

When the control flow in FIG. 3 starts, the regeneration start determining means C11 determines in step S10 whether or not the regeneration should be started, i.e., whether or not the rich control for the regeneration treatment of the catalyst is required. If it is determined in step S10 that the regeneration should be started, the flow proceeds to step S20, whereas if it is determined that the regeneration should not be started, the normal operation is performed for a predetermined time period (a time related to an interval for determining the start of the regeneration: e.g., Δt1) in step S11, and then the flow returns to step S10 where it is again determined whether or not the regeneration should be started.

This determination of the regeneration start is made in the following manner: For example, based on preliminarily input map data representing a relationship between a quantity representing an engine operating condition such as an engine speed or a load and the NOx exhaust amount, the NOx exhaust amount per unit time ΔNOx is calculated from the engine operating condition. By accumulatively calculating the calculated value ΔNOx since a previous regeneration control, the NOx accumulation amount ΣNOx is obtained. The regeneration start is determined based on whether or not the NOx accumulation amount ΣNOx has exceeded the predetermined criterion value Cn. In addition, based on a difference ΔCm (=Cnoxin−Cnoxout) between the inlet NOx concentration Cnoxin and an outlet NOx concentration Cnoxout and the air-intake amount Va measured by the mass air flow sensor 6, the NOx exhaust amount per unit time ΔNOx is calculated as ΔNOx (=ΔCm*Va), if a measured NOx concentration is used. By accumulatively calculating ΔNOx, the NOx accumulation amount ΣNOx is obtained.

In step S20, the transition-to-rich controlling means C12 gradually advances in angle the fuel injection timing T from the lean fuel injection timing Tl to the target fuel injection timing Tq for rich combustion in response to the change in combustion air/fuel ratio (air excess ratio λn) during the transition.

More particularly, as shown in FIG. 4, the air-intake system rich controlling means C16 performs control in step S21 so as to throttle the air-intake throttle valve 8 and open the EGR valve 12 to increase the EGR amount, and thereby reduces a subsequent air-intake amount. Then, in the next step S22, the fuel system rich controlling means C17 controls the fuel injection valve 16 to thereby increase the fuel injection amount in the cylinder injection up to a predetermined fuel injection amount for the regeneration control.

Subsequently, in step S23, based on the oxygen concentration measured by the first exhaust component concentration sensor 23 (or oxygen concentration sensor), or based on the amount of the fuel injected into the cylinder and the air-intake amount detected by the mass air flow sensor (MAF sensor) 6, the instant air excess ratio λn (air excess ratio λ every moment) is calculated.

In the next step S24, the instant injection timing Tn is calculated based on, for example, an expression of $Tn=f(\lambda n)=(Tq-Tl)*((\lambda l-\lambda n)/(\lambda l-\lambda q))+Tl$, where the Tq is the targeted injection timing, Tl the fuel injection timing for lean control, λq the target rich air excess ratio, and λl the lean air excess ratio. The instant injection timing Tn may be calculated as such a function value, or calculated based on the preliminarily input map data.

In the following step S25, the main fuel injection timing T is advanced in angle so as to come to the instant injection timing Tn, and then the regeneration control is performed for a predetermined time period (e.g., Δt2). Subsequently, in step S26, it is checked whether or not the instant injection timing Tn has become equal to or more than the target injection timing Tq ($Tn \geqq Tq$), and if Tn is equal to or more than Tq, step S20 is completed. On the other hand, if the instant injection timing Tn is less than the targeted injection timing Tq, the flow returns to step S23.

In other words, in step S20, the following control is performed at the predetermined time intervals Δt2 until the instant air excess ratio λn reaches the target air excess ratio λq for catalyst regeneration: The instant injection timing Tn is calculated every moment based on the instant air excess ratio λn as $Tn=f(\lambda n)$. The main fuel injection is performed at the instant injection timing Tn to thereby gradually advance in angle from the fuel injection timing Tl for lean control to the targeted injection timing Tq.

After step S20 has been completed, the flow proceeds to step 30 of regeneration continuation control as shown in FIG. 3. In step S30, the air-intake rich controlling means C16 continues to perform the control of throttling the air-intake throttle valve 8 and the control of opening the EGR valve 12 to increase the EGR amount, and thereby continues the decreasing condition of the subsequent air-intake amount. Also, the fuel system rich controlling means C17 continues the regeneration control for a predetermined time period (e.g., Δt3) under the condition of the increased fuel injection amount and the main fuel injection advanced in angle to the target injection timing Tq in the cylinder fuel injection.

By the regeneration continuation control in step S30, the exhaust gas is kept in the rich condition with the predetermined targeted air/fuel ratio λq and also in a predetermined temperature range (although depending on the catalyst, approximately 200 to 600° C. for catalyst regeneration, and 500 to 750° C. for sulfur poisoning recovery, which is a temperature range in which desulfurization can be performed).

After the step S30, the regeneration completion determination means C14 determines in step S40 whether or not the regeneration has been completed. If it determines in this determination step that the regeneration has not been completed, the flow returns to step S30 where the regeneration continuation control is repeatedly performed until the regeneration is completed. On the other hand, if the regeneration has been completed, the flow proceeds to step S50 of the transition-to-lean control.

The determination of the completion of the regeneration is made based on whether or not the regeneration duration has exceeded the predetermined time period for regeneration control completion, and if it has exceeded the time period, the regeneration is determined to be completed. Alternatively, if the NOx concentration is measured, the determination may be made based on whether or not the difference ΔCm (=Cnoxin−Cnoxout) between the inlet NOx concentration Cnoxin and the outlet NOx concentration Cnoxout is larger than a predetermined criterion value Dn. That is, if ΔCm has become equal to or more than the predetermined criterion value Dn, the rich control is completed on an assumption that the NOx purifying ability has been recovered. Still alternatively, the determination may be made based on whether or not a ratio RCm (=Cnoxout/Cnoxin) between the outlet NOx concentration Cnoxout and the inlet NOx concentration Cnoxin is larger than a predetermined criterion value Rn.

In step S51, as shown in step S50 of FIG. 5, the air-intake system rich control means C16 stops the control of throttling the air-intake valve 8, and performs control of closing the EGR valve 12 to the extent of an opening level for the normal operation EGR to stop the increase in EGR amount performed in the rich control. This restores the new-air-intake amount to the amount for normal operation. In the next step S52, the fuel system rich control means C17 controls the fuel injection valve 16 to restore the fuel injection amount for in-cylinder injection to the fuel injection amount for normal operation, i.e., the lean operation.

Subsequently, in step S53, based on the oxygen concentration measured by the first exhaust component concentration sensor 23 (or oxygen concentration sensor), the instant air excess ratio λn (time-dependent air excess ratio λ) is calculated. Alternatively, the instant air excess ratio λn may be calculated based on the fuel amount injected into the cylinder, the air-intake amount detected by the mass air flow sensor (MAF sensor) 6, and the like.

In the next step S54, the instant injection timing Tn is calculated based on the expression of Tn=f(λn) or the like, similarly to step S24. In the subsequent step S55, the main fuel injection timing is delayed in angle so as to come to the instant injection timing Tn, and then the regeneration control is performed for a predetermined time period (e.g. Δt4). Subsequently, in step S56, it is checked whether or not the instant injection timing Tn has become equal to or less than the lean injection timing Tl (Tn≦Tl), and if Tn≦Tl, step S50 is completed. On the other hand, if Tn>Tl, the flow returns to step S53.

In other words, in step S50, the instant injection timing Tn is calculated every moment as Tn=f(λn) based on the instant air excess ratio λn at the predetermined time intervals Δt4 until the instant air excess ratio λn reaches the lean air excess ratio λl for normal operation. The main fuel injection is performed at the instant injection timing Tn to gradually delay in angle from the target injection timing Tq to the fuel injection timing Tl for lean control.

The control from step S20 to step S50 recovers the NOx purifying ability, and then the flow returns to step S10. The series of steps S10 to S50 is repeated. However, if an interrupt occurs due to engine stop or the like, the flow jumps to step S60 in the course of the control. In step S60, the following process is performed: Data before the interrupt occurs is stored. A control completion operation is performed, such as completion operations of respective control steps and various operating steps. The control is stopped (Stop), and then ended (End).

According to the control flow shown in FIGS. 3 to 5, during the switching intervals between the lean condition and the rich condition in the regeneration control of the NOx purification catalyst 12, i.e., during t1 or t2, the injection timing T of the main fuel injection into the cylinder can be changed in response to the time-dependent change in combustion air/fuel ratio (air excess ratio λn) in the cylinder.

Also, according to the exhaust gas purification method and exhaust gas purification system 1 described above, in the regeneration control for recovering the NOx purifying ability of the NOx purification catalyst 12, the fuel injection timing Tn is advanced or delayed in angle in response to the change in combustion air/fuel ratio (air excess ratio λn) in the cylinder that is caused by the air-intake throttling and EGR control in the air-intake system during the switching between the combustion condition where the combustion air/fuel ratio becomes lean and that where it becomes rich, without advancing or delaying in angle the fuel injection timing T at once to the predetermined target timing Tq or Tl. This can prevent NOx generation, combustion noise, rapid change in torque, extreme deterioration in drivability or the like.

In addition, the description above is made by exemplifying the NOx occlusion reduction type catalyst as the NOx purification catalyst; however, even if the direct reduction type catalyst is used as the NOx purification catalyst, the description is similar. In short, if the NOx purification catalyst can purify NOx in the lean condition and recover the NOx purifying ability in the rich condition, the present invention is applicable.

The exhaust gas purification method and exhaust gas purification system of the present invention with the excellent effects mentioned above can be very effectively utilized as an exhaust gas purification method and exhaust gas purification system for an internal combustion engine mounted on a vehicle, or the like.

What is claimed is:

1. An exhaust gas purification method for an exhaust gas purification system that includes a NOx purification catalyst for purifying NOx when an air/fuel ratio of exhaust gas is in a lean condition and for recovering a NOx purifying ability when the air/fuel ratio is in a rich condition, and a catalyst regeneration controller for performing regeneration control to recover the NOx purifying ability of the NOx purification catalyst, and uses air-intake system control for decreasing an air-intake amount and fuel system control for increasing a fuel injection amount into a cylinder in combination, thereby controlling the rich condition for the regeneration control, the method comprising the steps of:

measuring an oxygen concentration in an exhaust passage of the system;

calculating a time-dependent combustion air/fuel ratio in the cylinder based directly on the oxygen concentration measured in the exhaust passage;

calculating an instant injection timing based on the time-dependent combustion air/fuel ratio in the cylinder; and changing an injection timing of the fuel injection into the cylinder to bring the injection timing to the instant injection timing during switching intervals from the lean condition to the rich condition and from the rich condition to the lean condition in the regeneration control of the NOx purification catalyst, wherein, the angle of the injection timing of the fuel injection into the cylinder is advanced to bring the injection timing to the instant injection timing during the switching intervals from the lean condition to the rich condition at a beginning of the regeneration control, at a start time of a transition to the rich condition, decreasing an air-intake amount and increasing a fuel amount, and then advancing in angle the injection timing from a lean fuel injection timing to a target fuel injection timing for rich combustion in response to a change in combustion air/fuel ratio, which is a relatively slow change during the transition, at a time of continuing the regeneration control after the transition to the rich condition, decreasing the air-intake amount and increasing the fuel amount, and making the injection timing stay in a condition of the target fuel injection timing, and the angle of the injection timing of the fuel injection into the cylinder is delayed to bring the injection timing to the instant injection timing during the switching intervals from the rich condition to the lean condition at an end of the regeneration control, at a start time of a transition to the lean condition, decreasing the air-intake amount and increasing the fuel amount, and then gradually delaying in angle from the target fuel injection timing to the lean fuel injection timing in response to the relatively slow change in combustion air/fuel ratio.

2. An exhaust gas purification system, comprising:

a NOx purification catalyst for purifying NOx when an air/fuel ratio of exhaust gas is in a lean condition, and for recovering a NOx purifying ability when the air/fuel ratio is in a rich condition;

a catalyst regeneration controller for performing regeneration control to recover the NOx purifying ability of the NOx purification catalyst, and using air-intake system control for decreasing an air-intake amount and fuel system control for increasing a fuel injection amount into a cylinder in combination, thereby controlling the rich condition for the regeneration control; and a sensor to measure oxygen concentration in an exhaust passage of the system, wherein the catalyst regeneration controller calculates a time-dependent combustion air/fuel ratio in the cylinder based directly on the oxygen concentration measured in the exhaust passage, calculates an instant injection timing based on the time-dependent combustion air/fuel ratio in the cylinder, and changes an injection timing of the fuel injection into the cylinder to bring the injection timing to the instant injection timing during switching intervals from the lean condition to the rich condition and from the rich condition to the lean condition in the regeneration control of the NOx purification catalyst, wherein, the catalyst regeneration controller advances in angle the injection timing of the fuel injection into the cylinder to bring the injection timing to the instant injection timing during the switching intervals from the lean condition to the rich condition at a beginning of the regeneration control, an air-intake system rich controller decreases an air-intake amount and a fuel system rich controller increases a fuel amount, and then a transition-to-rich controller gradually advances in angle the injection timing from a lean fuel injection timing to a target fuel injection timing for rich combustion in response to a change in combustion air/fuel ratio, which is a relatively slow change, wherein at a time of continuing the regeneration control after the transition to the rich condition, the air-intake system rich controller decreases the air-intake amount and the fuel system rich controller increases the fuel amount, and a regeneration continuation controller makes the injection timing stay in a condition of the target fuel injection timing, and wherein, the catalyst regeneration controller delays in angle the injection timing of the fuel injection into the cylinder to bring the injection timing to the instant injection timing during the switching intervals from the rich condition to the lean condition at an end of the regeneration control, at a start time of a transition to the lean condition, the air-intake system rich controller decreases the air-intake amount and the fuel system rich controller increases the fuel amount, and then a transition-to-lean controller gradually delays in angle the injection timing from the target fuel injection timing to the lean fuel injection timing in response to the relatively slow change in combustion air/fuel ratio.

3. The exhaust gas purification system according to claim 2, wherein the NOx purification catalyst is a NOx occlusion reduction type catalyst for occluding NOx when the air/fuel ratio of the exhaust gas is in the lean condition, and for releasing and reducing the occluded NOx when the air/fuel ratio is in the rich condition, or a NOx exhaust gas is in the lean condition, and recovering the NOx purifying ability when the air/fuel ratio is in the rich condition.

* * * * *